US008087555B2

(12) United States Patent
Criscuolo

(10) Patent No.: US 8,087,555 B2
(45) Date of Patent: Jan. 3, 2012

(54) GARMENT ORGANIZER

(76) Inventor: Maria T. Criscuolo, Darien, CT (US)

( * ) Notice: Subject to any disclaimer, the term of this patent is extended or adjusted under 35 U.S.C. 154(b) by 1154 days.

(21) Appl. No.: 11/832,385

(22) Filed: Aug. 1, 2007

(65) Prior Publication Data

US 2007/0278260 A1 Dec. 6, 2007

(51) Int. Cl.
*A41D 27/22* (2006.01)

(52) U.S. Cl. ..... 223/85

(58) Field of Classification Search ..... 223/85, 223/88, 92, 95, 87; 206/278, 284–291
See application file for complete search history.

(56) References Cited

U.S. PATENT DOCUMENTS

| | | | | |
|---|---|---|---|---|
| 2,089,266 | A * | 8/1937 | Kalvin | 211/85.3 |
| 3,327,912 | A | 6/1967 | Blair | |
| 3,406,882 | A | 10/1968 | Phillips | |
| 3,837,476 | A * | 9/1974 | Schwartz | 206/278 |
| 4,542,838 | A * | 9/1985 | Perez-Tubens et al. | 223/85 |
| 4,744,496 | A | 5/1988 | Blanchard et al. | |
| 4,856,688 | A * | 8/1989 | Ackmann | 224/217 |
| 4,930,693 | A * | 6/1990 | Schwab | 223/66 |
| 4,940,174 | A * | 7/1990 | Parker | 223/85 |
| 5,005,742 | A * | 4/1991 | Smith | 223/85 |
| 5,065,916 | A | 11/1991 | Fildan | |
| 5,078,307 | A * | 1/1992 | Suddath | 223/92 |
| 5,558,383 | A * | 9/1996 | Lancellotti | 294/143 |
| 5,894,969 | A * | 4/1999 | Speckert | 223/85 |
| 5,967,388 | A | 10/1999 | Kolton et al. | |
| 6,000,588 | A | 12/1999 | Kolton et al. | |
| 6,250,523 | B1 | 6/2001 | Louw | |
| 6,296,094 | B1 * | 10/2001 | Knecht | 206/281 |
| D454,006 | S * | 3/2002 | Gouldson | D6/326 |
| D469,964 | S * | 2/2003 | Gouldson | D6/326 |
| 6,761,291 | B2 | 7/2004 | Moskovitz et al. | |
| 2003/0102239 | A1 * | 6/2003 | Beard | 206/440 |
| 2007/0187289 | A1 * | 8/2007 | Markson et al. | 206/743 |

FOREIGN PATENT DOCUMENTS

| | | | |
|---|---|---|---|
| GB | 2095987 | A * | 10/1982 |
| GB | 2236523 | A * | 4/1991 |

* cited by examiner

*Primary Examiner* — Nathan Durham
(74) *Attorney, Agent, or Firm* — Edwards Wildman Palmer LLP

(57) ABSTRACT

A garment organizer includes a plurality of garment holders configured and adapted to hold an garment, and a connection element connecting the plurality of garment holders, facilitating viewing of individual garments. A method of organizing garments, includes the steps of providing a garment organizer, placing a garment on at least one garment holder, and storing the garment organizer and garments.

9 Claims, 10 Drawing Sheets

GARMENT ORGANIZER

BACKGROUND OF THE INVENTION

1. Field of the Invention

The present invention relates to garment organizers. Particularly, the present invention is directed to devices for, and methods of organization of undergarments, but may be applied to other garments or items as well.

2. Description of Related Art

A variety of devices, such as hangers and the like, are known in the art for display or storage of garments, including undergarments. Of such devices, many are constructed of plastic and are intended only for use in display and storage of garments in retail establishments. Upon purchase, such hangers are removed from the purchased garment and reused to display other garments for sale. In other instances, disposable sheets of paperboard are used to stiffen items for display, which are then discarded by the consumer.

Such conventional methods and systems generally have been considered satisfactory for their intended purpose. However, such devices are not suitable for organization of multiple garments in one's home, or for display of multiple garments of a set, for example.

Typically, particularly in the case of ladies' undergarments, a variety of shapes and configurations of undergarments are often purchased by any one person. Such a variety of undergarments does not allow for easy and consistent storage of all undergarments. If folded, undergarments that are different in shape cannot necessarily be folded in the same way as other undergarments and neatly stored. Further, when folded the undergarments may have different sizes, making organization even more difficult. Moreover, when one desires to wear a particular undergarment, one must sort through a variety of other undergarments, which often results in unfolding thereof, and subsequent disorganization.

Accordingly, there remains a need in the art for a device to facilitate organization of undergarments that addresses the foregoing issues. There also remains a need in the art for a storage and organization device that is suitable for use within the home, and that is easy to use. The present invention provides a solution to these problems.

SUMMARY OF THE INVENTION

The purpose and advantages of the present invention are set forth in and are apparent from the description that follows. Additional advantages of the invention will be realized through practice of the invention, including use of the devices and methods particularly pointed out in the written description, claims and in the appended drawings.

To achieve these and other advantages, and in accordance with the purpose of the invention, as embodied, the invention includes a garment organizer including a plurality of garment holders configured and adapted to hold a garment and a connection element for connecting the plurality of garment holders, facilitating viewing of individual garments. The garment can be an undergarment, such as underwear or a brassiere, or alternatively can be hosiery or another garment, for example.

The plurality of garment holders can take on any of a variety of shapes, as desired or required by the particular garment to be held. For example, the garment holders can be substantially T-shaped, substantially heart-shaped, can include arcuate surfaces, or can have concave or convex portions, for example. The precise shape of the garment holders can be selected based on the garment to be held, and other considerations, such as a particular shape to enhance a marketing plan. Additionally, garment holders can be manufactured in a complete range of sizes in order to accommodate garments of different sizes, such as extra-small, small, medium, large and extra-large sizes, for example. Similarly, the materials and colors used to construct garment holders in accordance with the invention can be selected as desired or required. Garment holders can include a contour to follow the overall shape of the undergarment to be held. Alternatively or additionally, the garment holders can include a contour to mimic a portion of the silhouette of a wearer. Garment organizers in accordance with the invention can further include an outer cover to conceal the undergarments. The outer cover can be a box and lid, for example, or can simply be one or more planar covers that sandwich the garment holders and garments therebetween.

Garment holders for garment organizers constructed in accordance with the present invention can be formed of plastic, metal, wood, a combination thereof or other materials. Such material can constitute the entire garment holder or alternatively can form a frame or skeleton to be covered by another material, such as fabric. If covered in fabric, any suitable material, such as silk, cotton or wool can be used. Different knits or weaves of such material can be used, such as a terry-cloth, for example. Moreover, padding such as a foam, foam rubber, cork or cotton and/or polyester batting can be used underneath the fabric covering and over the frame.

The plurality of garment holders can be mutually connected by a connector such as a ring-shaped connector, passing through apertures defined in each garment holder. Alternatively, the connection elements can include mating protrusions and recesses, such that a protrusion of one garment holder engages a recess on an adjacent garment holder.

The garment organizer can be embodied such that the garment holders are mutually connected to enable a fanning separation of the garment holders. In some embodiments, this is accomplished by providing a pivot at one end of each garment holder. Such pivot can be formed, for example, by providing a ring passing through apertures defined in each garment holder. Garment organizers designed and constructed in accordance with the invention can alternatively be arranged so as to open as a book along one edge, as an accordion, can be arranged to interlock and stack together, or a combination thereof.

In accordance with the invention, garments can be secured to the garment holders by any suitable means, including but not limited to one or more clips, straps, hooks, protrusions, teeth, angled surfaces, concave surfaces, adhesives or high friction materials, such as rubber. Such features can be integrally molded or insert molded with the remainder of the garment holder, if the material used allows such forming process. Hooks, straps, clips and other elements can be embodied as softer elements than the remainder of the garment holder. This can be accomplished, for example, by insert molding, with the garment holder, such elements, which can be previously formed of a softer material. Alternatively, such elements can be integrally formed with the garment holder, such as by forming them to be thinner than the remainder of the garment holder, thus making them relatively more flexible. Naturally, such elements can alternatively be separately attached to the garment holder during the manufacturing process.

Further, a garment can be pinned to the garment holder, provided the material used for the garment holder enables such attachment. For example, a padded garment holder would allow a pin, such as a straight pin, to attach the garment to the garment holder.

Additionally, one or more areas can be provided on the garment organizer or on each garment holder individually, to allow display of indicia. Such indicia can include a logo of a manufacturer or vendor, a trademark or the like. Additionally or alternatively, indicia can include labels, which can be customized by the user. Such labels can take on a variety of embodiments, but can include, for example, a paper label held in a clear pocket provided on the garment organizer and/or on individual garment holders.

In accordance with another aspect of the invention, a garment organizer is provided having a plurality of garment holders and one or more connecting elements adapted and configured to mutually connect the plurality of garment holders. The plurality of garment holders are configured and adapted to hold an undergarment, and include an upper portion and a lower portion. The upper portion is adapted and configured to engage a waistband of an undergarment, and the lower portion extends from the upper portion and is adapted and configured to engage a lower portion of the undergarment.

The invention also includes a method of organizing garments. The method includes the steps of providing a garment organizer in accordance with the invention, placing a garment on at least one garment holder, and storing the garment organizer and garments.

It is to be understood that both the foregoing general description and the following detailed description are exemplary and are intended to provide further explanation of the invention. It is also to be understood that features described in connection with one embodiment can be applied to other embodiments set forth herein, and that such embodiments are conceived by the Applicant, although such embodiments may not be specifically identified in this paper.

BRIEF DESCRIPTION OF THE DRAWINGS

The accompanying drawings, which are incorporated herewith and constitute part of this specification, are included to illustrate and provide a further understanding of the devices and methods of the invention. Together with the description, the drawings serve to explain the principles of the invention, wherein:

FIGS. 26 and 27 illustrate garment holders in accordance with the invention that are particularly suited for use in holding brassieres, and the like.

DETAILED DESCRIPTION OF THE PREFERRED EMBODIMENT

Reference will now be made in detail to the presently preferred embodiments of the invention, examples of which are illustrated in the accompanying drawings. The method and corresponding steps of the invention will be described in conjunction with the detailed description of the related devices.

The devices and methods presented herein may be used for organization and storage of garments. The present invention is particularly suited for organization and storage of undergarments, such as underwear or brassieres.

In accordance with the invention, a garment organizer includes one or more garment holders, each configured and adapted to hold a garment. Further, one or more connection elements for connecting the plurality of garment holders are provided, which arrangement facilitates viewing of individual garments.

Figure 1:
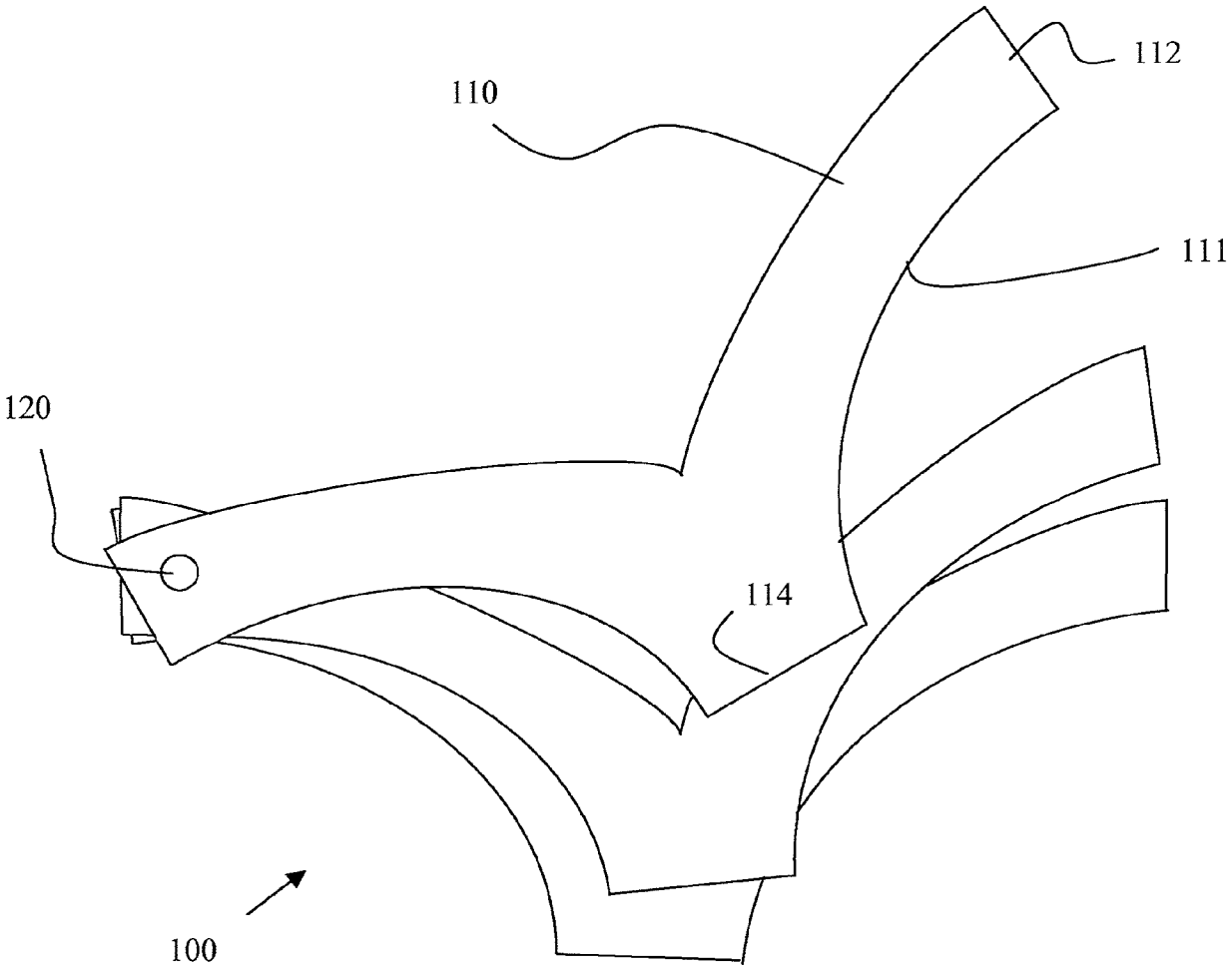
FIG. 1 is a top view of a first representative embodiment of a garment organizer constructed in accordance with the present invention, in which a plurality of garment holders are arranged to pivot about a single connecting element.

For the purposes of explanation and illustration, and not limitation, an exemplary embodiment of a garment organizer in accordance with the invention is shown in FIG. 1 and is designated generally by reference character 100. Other embodiments of a garment organizers in accordance with the invention, or aspects thereof, are provided in FIGS. 2-27, as will be described hereinbelow.

FIG. 1 illustrates a garment organizer 100, having a plurality of garment holders 110. The garment holders 110 can be substantially T-shaped overall, with an arcuate edge 111 connecting side edges to the bottom edge 114. As illustrated, a concave feature along the upper surface of the garment holder 110 can be provided. In the arrangement illustrated, the garment holders 110 are mutually connected at a pivot, which is embodied as an aperture 120, though which a connection element, such as a ring, can be inserted. Alternatively, a rod with enlarged ends can be used. The precise location of the pivot with respect to the garment holders 110 can be selected as desired. In this embodiment, arranging the pivot at one end allows the garment holders 110 to fan apart, which facilitates sorting through various undergarments. As will be appreciated from alternate embodiments, multiple pivots can be used in one garment organizer.

An undergarment—in this embodiment, underwear—is placed on the garment holder 110, so that the waist band is held on the upper portion 112 of the garment holder 110, while the portion of the undergarment between leg openings abuts or is held by the lower edge 114 of the garment holder 110.

Depending on the particular shape of the undergarment, the pivot might interfere with the undergarments or vice versa. Accordingly, the pivot can be placed near the upper edge of the garment holder 110, or may be provided on a protrusion extending from the garment holder 110, away from the region in which the undergarment is held.

Figure 2:
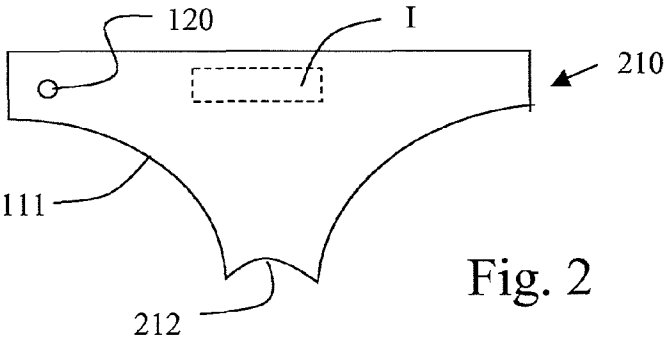
FIGS. 2-6 illustrate a variety of alternative shapes for garment holders in accordance with the invention.

As depicted in FIGS. 2-6, garment organizers in accordance with the invention can take on a variety of forms in addition to that described in connection with FIG. 1. As shown in FIG. 2, the garment holder 210 can additionally include a concave portion 212 to better engage the respective portion of an undergarment held thereby. FIG. 2 additionally includes a region I for display of indicia. Such indicia can any of a number of elements, such as a logo, or alternatively can include a clear pocket for insertion of a label. The precise location of the indicia can be other than that illustrated, as desired or required.

Figure 3:
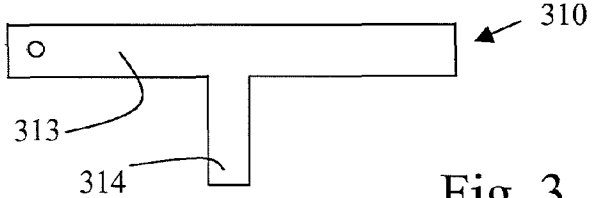
Figure 4:
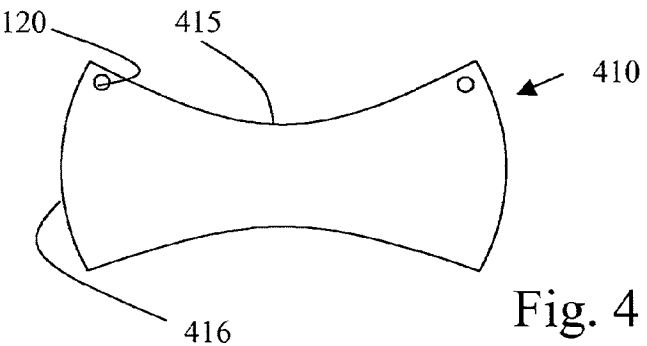
Figure 5:
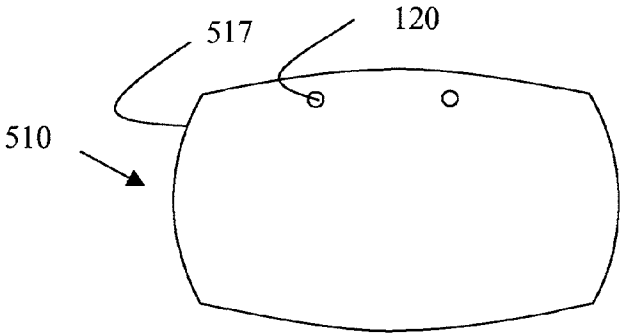
Figure 6:
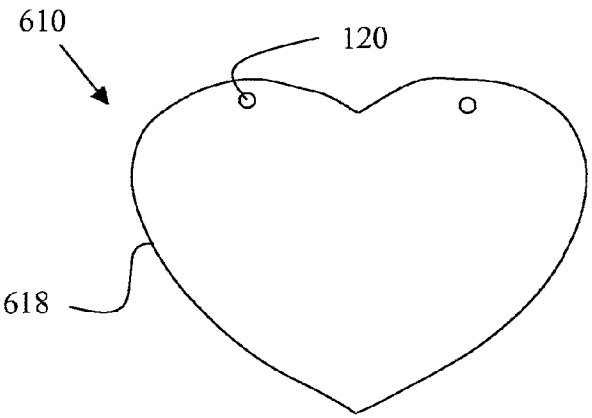

As illustrated in FIG. 3, a garment holder 310 in accordance with the invention can have a simple T-shape, with a relatively long upper portion 313 and a perpendicularly arranged lower portion 314. As illustrated in FIGS. 4-6, garment holders 410, 510, 610 are provided with convex contours 416, 517 and 618, respectively. Such contours can facilitate engagement with an undergarment by mimicking the contour of the garment and/or of the silhouette of a wearer. Such contours can thereby help prevent inadvertent removal of the undergarment from the garment holder. Additionally, the garment holder 410 of FIG. 4 includes a concave contour on upper and lower edges thereof. Such an arrangement can help reduce material and thus, the weight of the garment holder 410, and may also be desirable for aesthetic reasons. Additionally, as can be seen, the embodiments of FIGS. 4-6 each include a plurality of connection apertures 120. Accordingly, such garment holders can be mutually connected by one or more of the connection elements, as desired.

FIG. 6 illustrates one embodiment where a garment holder 610 includes functional convex contours 618, as described above, but is shaped substantially as an iconic heart. Such a shape, or other iconic shapes, may be desirable, depending on the precise use of the garment organizer.

Figure 7:
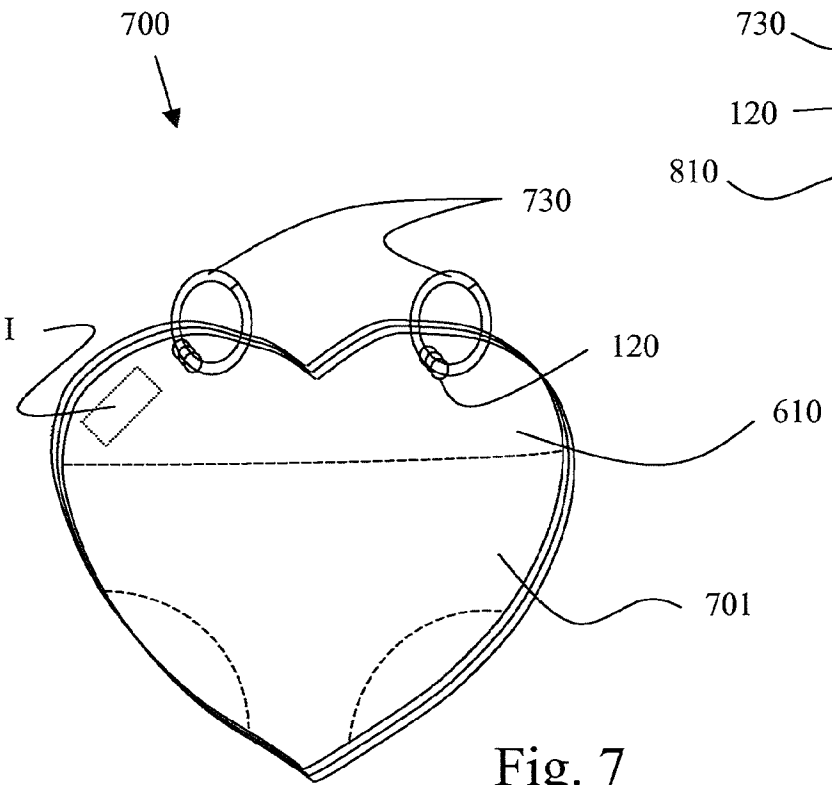
FIG. 7 illustrates a garment organizer in accordance with the invention wherein each of a plurality of garment holders is substantially heart-shaped.

As illustrated in FIG. 7, a garment organizer 700 can include a plurality of garment holders 610 connected by a plurality of connection elements, in this case, a plurality of rings 730. The plurality of connection elements in this embodiment allows the individual garment holders 610 to open like a book, keeping each garment holder 610 neatly oriented with respect to other garment holders 610. The position of a representative undergarment 701 to be held thereby is illustrated in dashed lines. As can be seen, the undergarment 701 does not interfere with the connecting rings 730, and thus does not interfere with perusal of the garments held thereby. Additionally, a region I for display of indicia is provided, the precise location of which may be different from that illustrated.

Figure 8:
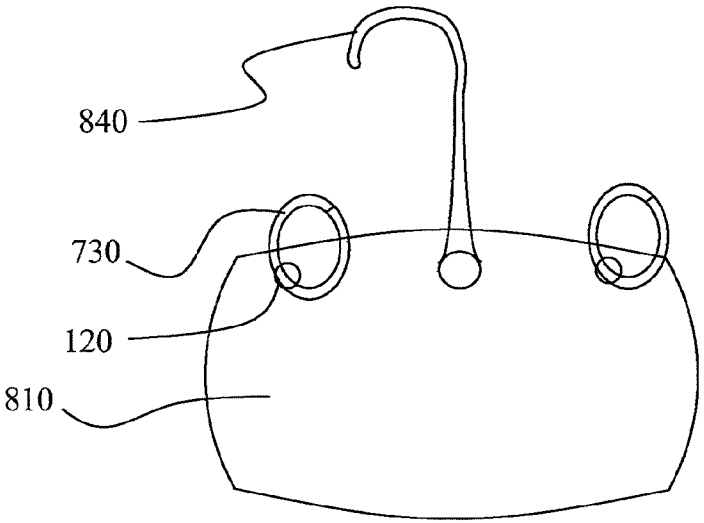
FIGS. 8-10 illustrate embodiments of garment organizers in accordance with the invention that are capable of being hung from a closet rod, for example.

FIG. 8 illustrates a further embodiment of a garment holder 810 in accordance with the invention, where a plurality of apertures 120 and connecting rings 730 are provided. Further, a hanger 840 is also provided thereon for supporting the garment organizer, such as on a closet rod.

Figure 9:
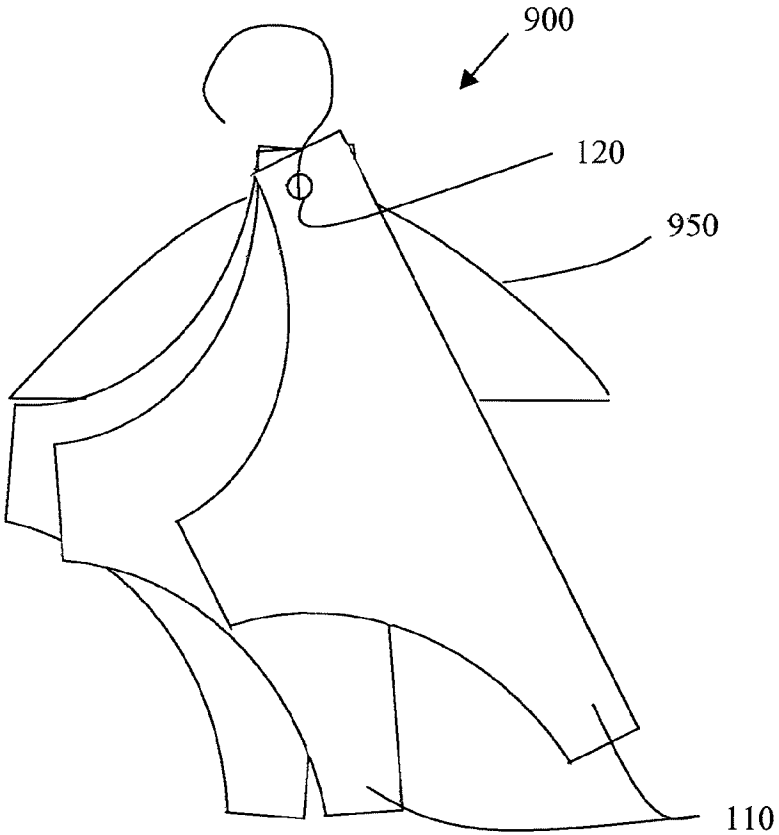

FIG. 9 illustrates a garment organizer 900 in accordance with the invention, where a plurality of garment holders 110, each with an aperture 120 defined therein, are held by a conventional hanger 950, which thus functions as a connecting element. Accordingly, all garments held on the garment holders 110 remain organized and attached to their respective holders 110, and can be hung together in a closet, for example.

Figure 10:
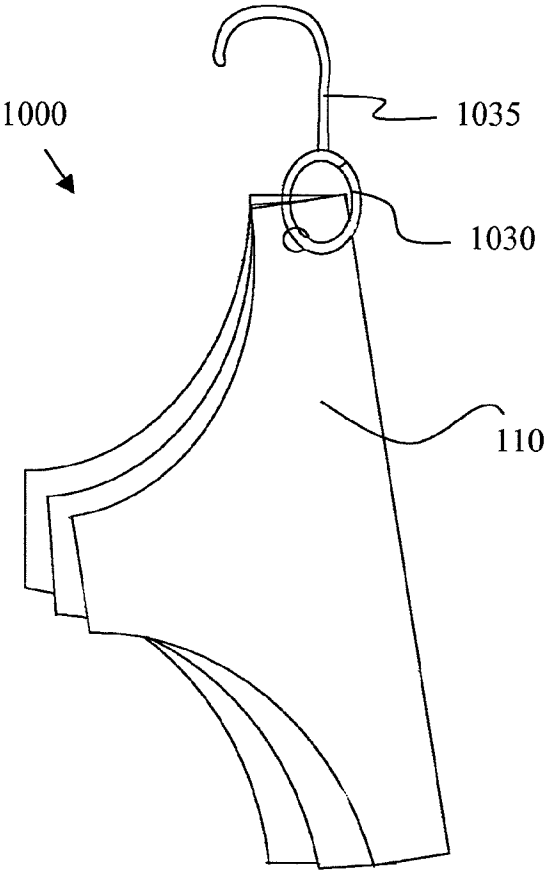

Similarly, the garment organizer 1000 of FIG. 10 includes a plurality of garment holders 110 connected by a connecting element having both a ring portion 1030 and a hook portion 1035. As with the embodiment of FIG. 9, all garments held on the garment holders 110 can be hung in a closet, for example.

Figure 11:
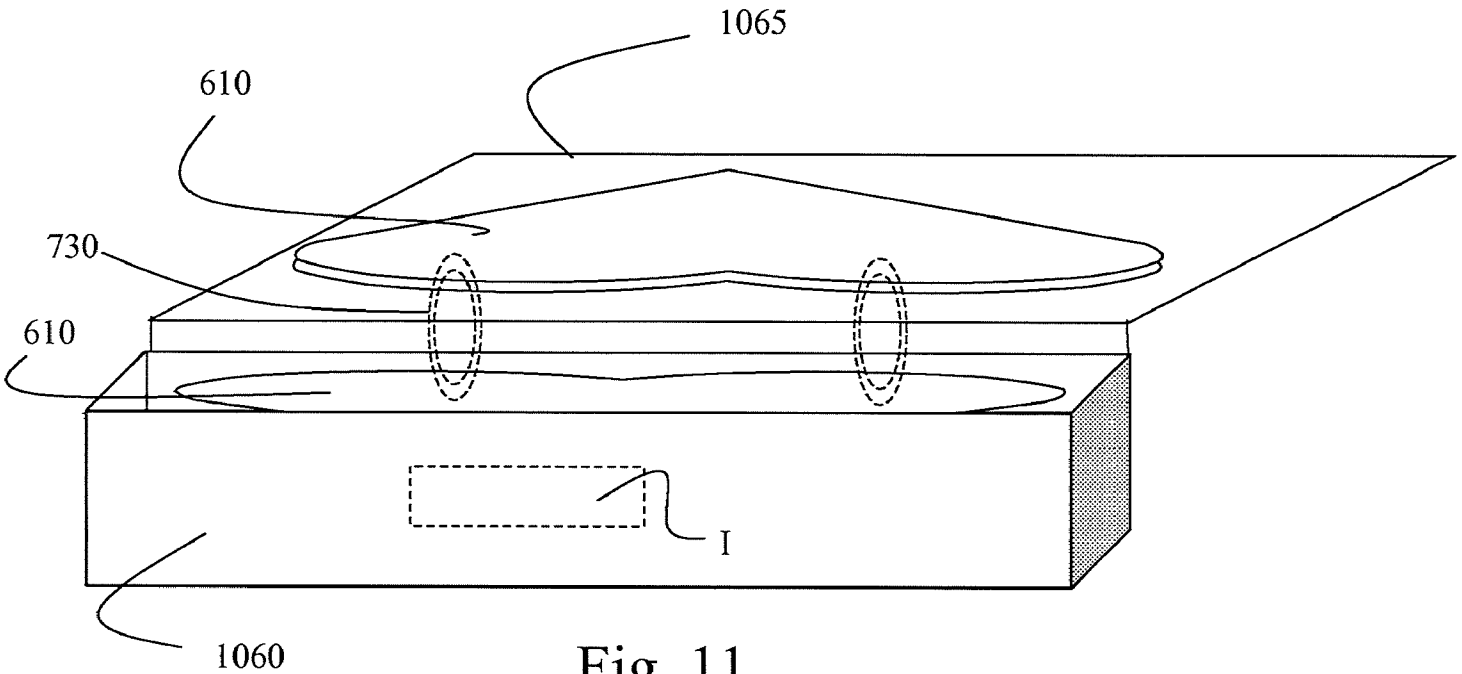
FIG. 11 illustrates a garment organizer in accordance with the invention including an outer cover in the form of a box.
Figure 14:
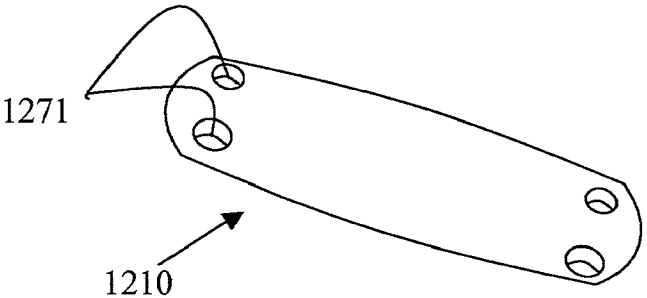
FIGS. 12-15 illustrate a stackable garment holder for use in a garment organizer in accordance with the invention.
Figure 15:
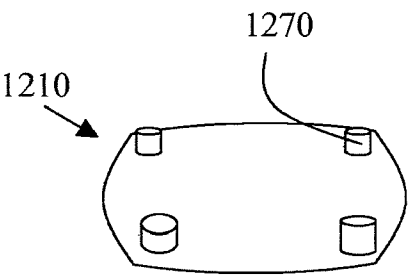
Figure 12:
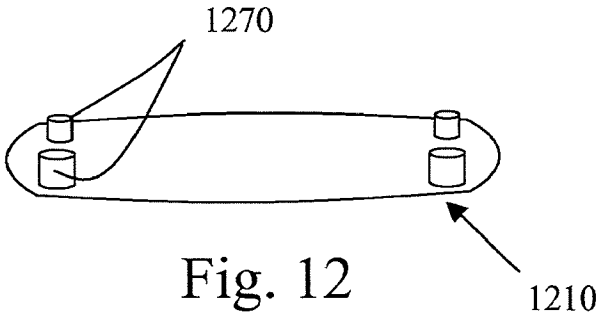
Figure 13:
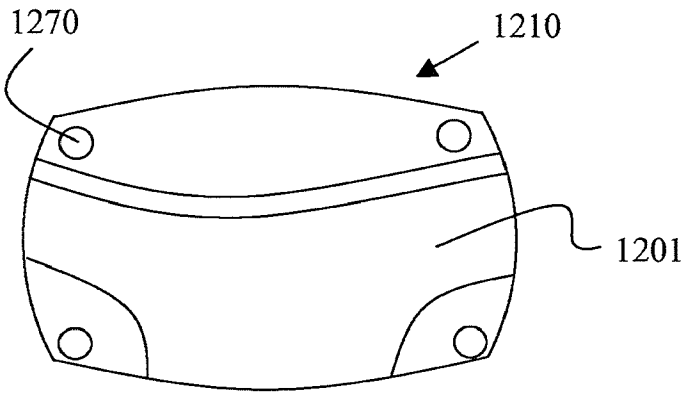

FIG. 11 illustrates a garment organizer having garment holders 610, ring-shaped connecting elements 730 and an outer cover including a box 1060 and lid 1065. The connecting elements 730 can be embodied so as to only mutually attach the garment holders 610, or alternatively can be embodied so as to additionally mutually attach the box 1060 and/or lid 1065. That is, the garment holders 610 and connecting elements 730 can be removable from the box 1060, or can be mutually attached thereto, depending on the precise implementation. In either case, viewing and perusal of a variety of undergarments can be easily achieved without disorganizing the undergarments. Further, in the embodiment of FIG. 11, as may be applied to any embodiment set forth herein, a region I for display of indicia is provided, the precise location of which may be different from that illustrated.

FIGS. 12-15 illustrate a further embodiment of a garment holder 1210 in accordance with the invention. As can be seen, the overall shape of the garment holder 1210 is similar to that of the embodiment of FIG. 5. However, the garment holder 1210 additionally includes integrally formed connecting elements 1270, which allow adjacent garment holders 1210 to interlock in a stacking fashion. As can be seen, an undergarment 1201 held by the garment holder 1210 does not interfere with the connection elements 1270.

The connecting elements 1270 can be formed so as to have a recess 1271 on one side and a protrusion on the other, such that the protruding portion of one garment holder 1210 is received by the recess 1271 of an adjacent garment holder 1270. In use, the embodiment of FIGS. 12-15 allows easy access to individual undergarments, simply requiring detachment of the garment holder 1210 holding the desired undergarment from the adjacent garment holder(s) 1210. The remaining garment holders 1210 and undergarments can then be returned to storage, such as in a dresser drawer or closet shelf.

FIGS. 16-23 illustrate various attachment elements to facilitate attachment of an undergarment to a garment holder in accordance with the invention. Such attachment elements can be applied to any garment holder described herein, and at any location on such garment holders, as desired or required. Typically, however, attachment elements can be provided at between one and three locations on each garment holder, such as at opposing ends of the garment holder for engaging the waistband of the undergarment and at the bottom portion of the garment holder for engaging the lower portion of an undergarment. More than three attachment elements can be used, if desired or if necessary for secure attachment of the undergarment to the garment holder.

Figure 16:
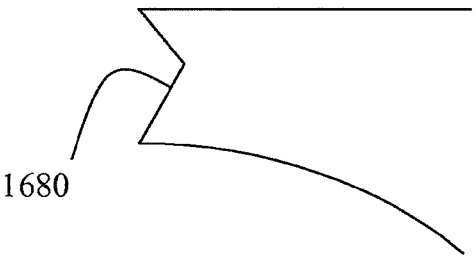
FIGS. 16-23 illustrate various attachment elements to facilitate attachment of an undergarment to a garment holder in accordance with the invention.

As illustrated in FIG. 16, an angled, recessed surface 1680 can be provided to facilitate engagement with an undergarment. This is particularly useful in cases where an undergarment includes an elastic waistband. In such instances, the tension inherent to an elastic waistband urges the waistband into the recessed angled surface 1680, thereby inhibiting removal of the undergarment from the garment holder. This attachment arrangement can be combined with other attachment elements set forth herein.

Figure 17:
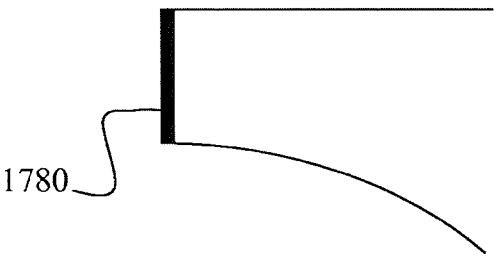

As illustrated in FIG. 17, a material 1780 to enhance attachment of an undergarment to a garment holder can be applied to the garment holder, such as a high-friction material. Such a material can be, for example, a rubber material. This feature can be combined with other connection elements set forth herein, such as the angled surface set forth in connection with FIG. 16.

Figure 18:
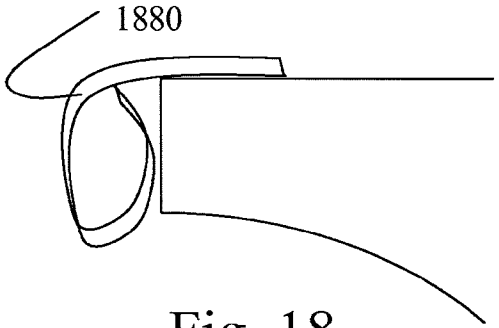

FIG. 18 illustrates a resilient clip 1880, which is attached to or integrally formed with a garment holder in accordance with the invention. The clip can be constructed of a plastic material, but may alternatively be made of a metal material, provided the clip is sufficiently resilient to deflect to a point to allow insertion of a portion of an undergarment, and thereafter to revert to its original position. The resilient clip 1880 is preferably configured to exert a small amount of pressure on the undergarment to inhibit inadvertent removal of the undergarment from the garment holder.

Figure 19:
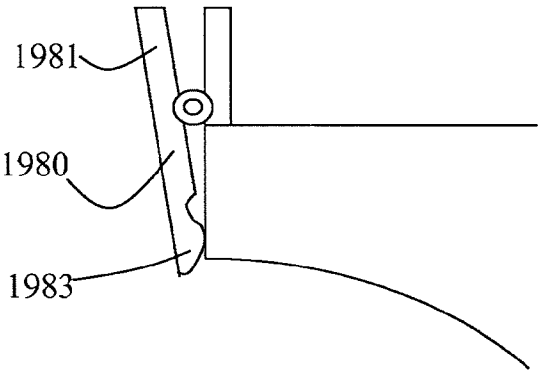

FIG. 19 illustrates a springed clothes-pin type clip 1980 provided to function similarly to the resilient clip 1880 of FIG. 18. To open the clip, a user pinches the distal end of the clip 1981 while inserting a portion of the undergarment 1983 at the proximal end thereof. Releasing the clip, pressure is exerted on the undergarment, which thereby holds the undergarment to the garment holder.

Figure 20A:
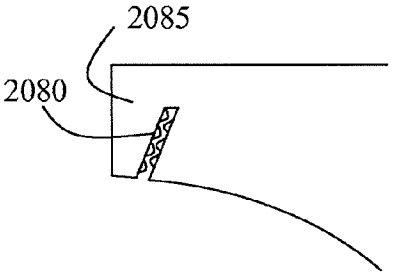

FIG. 20*a* illustrates an attachment feature 2080 in accordance with the invention, wherein a slot having rounded teeth is formed in the garment holder. A portion of the garment, such as the waistband, is inserted into the slot 2080, which deflects the end portion 2085 of the garment holder slightly, exerting pressure on the portion of the undergarment. If so embodied, the rounded teeth are arranged such that the path the garment would take to slip from the slot 2080 is tortuous to such an extent that it would not easily occur without intentionally being removed by a user.

Figure 20B:
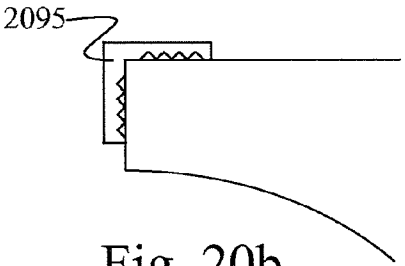

FIG. 20*b* includes a resilient attachment element 2095 secured to or integrally formed with the garment holder. The resilient attachment element 2095 can be formed of any suitable material, such as rubber or the like. If desired, the resilient attachment element 2095 can be overmolded over a relatively stiff frame, such as one made from metal or plastic. Naturally, the resilient attachment element 2095 can be integrally formed, molded onto or otherwise attached to the garment holder, as desired or required.

As can be seen in FIG. 20*b*, the resilient attachment element 2095 can hold a garment in its upper portion and/or in its lower portion. The upper portion of the resilient attachment element 2095 is particularly advantageous for holding garments such as bikini bottoms, which are often are held onto the wearer by relatively thin strings. Such strings can be securely gripped particularly well by the upper portion of the resilient attachment element 2095. As illustrated, the resilient attachment element 2095 can be secured to the garment holder in the middle portion thereof. Alternatively, the resilient attachment element 2095 can be embodied so as to engage garments by way of only its side portion or its top portion. In such embodiments, the resilient attachment element 2095 can be attached to the garment holder in a similar manner or other suitable manner, such as along the upper surface or end surface.

Figure 21:
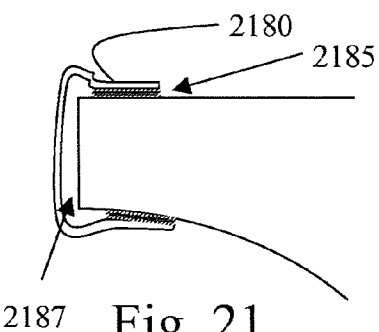

FIG. 21 illustrates an attachment element embodied in the form of a strap 2180. The strap 2180 is capable of being attached at both of its ends to the garment holder. One of the attachment points can be permanent, if so desired, but the other attachment point is removable to allow placement of a portion of an undergarment, such as a waistband, in a region 2187 defined between the strap 2180 and the garment holder. One or both attachment points of the strap 2180 to the garment holder can be hook-and-loop type fasteners, snaps, hooks or another attachment type. Permanent attachment at no more than one end can be accomplished by way of adhesive, mechanical press fit or an integral moulding of the strap 2180 and garment holder, for example. In use, the strap 2180 is detached at one end from the garment holder, the undergarment waistband is placed around the garment holder, and the detached end of the strap 2180 is looped around the undergarment waistband and reattached to the garment holder. Naturally, such a feature can be applied to the lower portion of the garment holder for engaging the lower portion of the undergarment, if desired.

Figure 22:
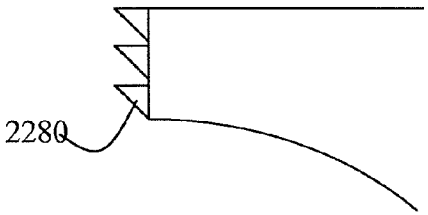

FIG. 22 illustrates an attachment feature for a garment holder in accordance with the invention including a plurality of angled teeth 2280 to engage a portion of an undergarment held thereby. The angled teeth 2280 can be of any size desired or necessary to result in sufficient engagement with the undergarment.

Figure 23:
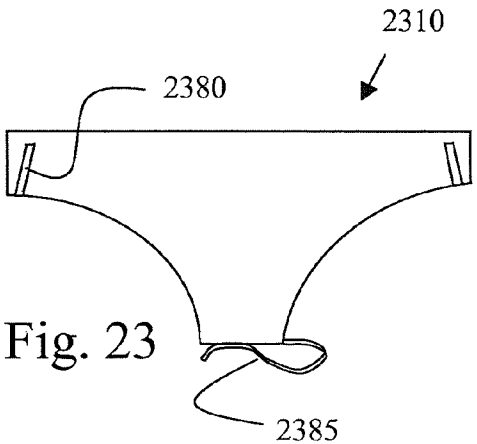

FIG. 23 illustrates a garment holder 2310 having two opposed angled slots 2380 for receiving an undergarment waistband, and a resilient clip 2385 arranged on a lower portion of the garment holder for receiving and engaging a lower portion of the undergarment. As set forth above, such a feature can be combined with any other features set forth herein.

Figure 24:
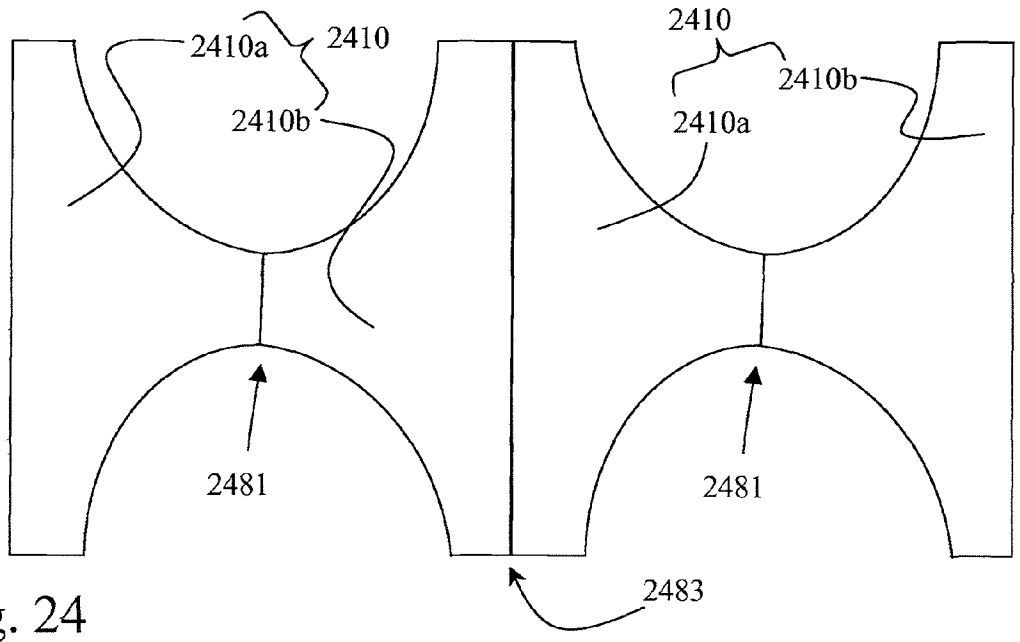
FIGS. 24 and 25 illustrate top and end views, respectively of a further embodiment of a garment organizer in accordance with the invention formed from a continuous sheet of material.
Figure 25:
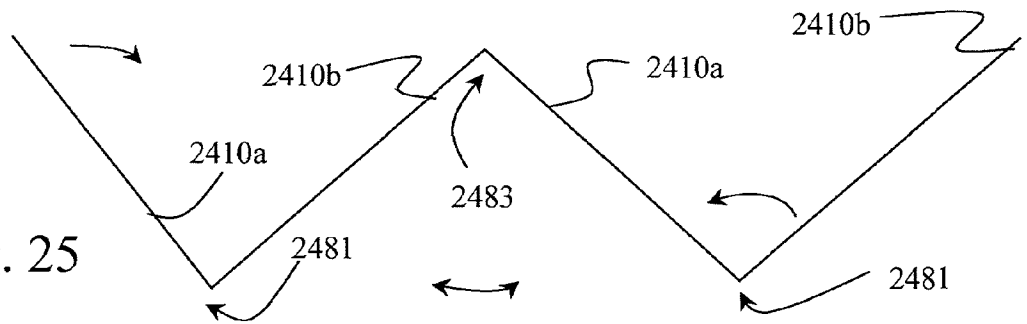

FIGS. 24 and 25 illustrate a further embodiment of garment holders 2410 constructed in accordance with the invention. For clarity, only two garment holders 2410 are illustrated. Each garment holder is composed of two halves—2410*a* and 2410*b*, attached along a fold line 2481. Each garment holder 2410 is then attached to each adjacent garment holder via another fold line 2483. Accordingly, garment organizers constructed in accordance with this embodiment of the invention can be formed of a single, continuous sheet of material. If desired, such material can be a plastic or alternatively, a stiff paperboard or corrugated cardboard, for example, depending on the specific purpose. As best seen in FIG. 25, upon forming the continuous chain of components, the organizer can be folded as indicated, and inside faces of garment holder halves 2410*a*, 2410*b* can be mutually adhered, such as by adhesive or a mechanical interlock if desired. Thus, each garment holder 2410 is formed of two layers of material, and is attached to the adjacent garment holder 2410 along a fold line 2483. This arrangement allows for easy perusal and selection of undergarments held thereby, as with foregoing embodiments. Naturally, any of the aforementioned features, such as attachment elements, can be provided on the garment holders 2410.

Figure 26:
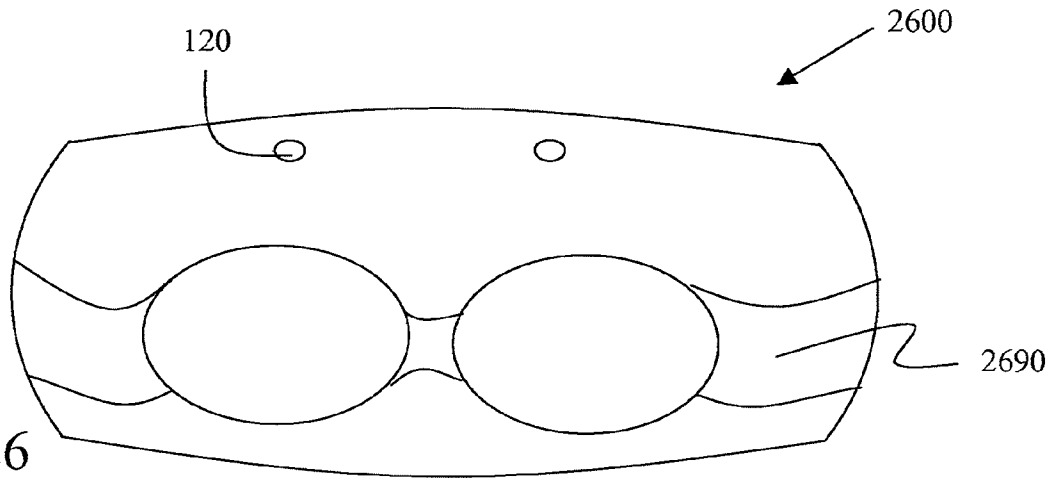
Figure 27:
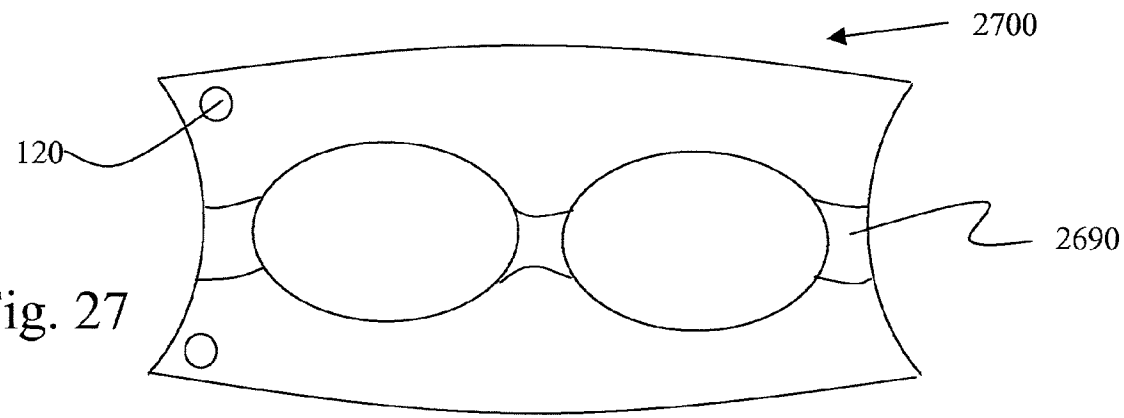

Finally, it is to be understood that aspects of the present invention can be applied to garment holders for garments other than underwear. FIGS. 26 and 27 illustrate garment holders 2600 and 2700, respectively that are adapted and configured to hold brassieres thereon. As illustrated, apertures 120 are provided on each garment holder for mutual connection with other like garment holders.

In the case of the garment holder 2600, the apertures 120 are provided near one lateral edge of the garment holder 2600. In the case of the garment holder 2700, the apertures 120 are provided near one longitudinal end thereof. Either arrangement allows for mutual attachment of garment holders and for perusal of the garments held thereby. Also, as can be seen, convex or concave longitudinal ends can be provided. Advantageously, concave longitudinal ends inhibit lateral movement of the garment 2690 held thereby.

In accordance with the invention, the materials and colors used can be selected as desired or required. Garment holders for garment organizers constructed in accordance with the present invention can be formed of plastic, metal, wood, paperboard, composite materials, other materials, or a combination thereof. Such material may be the only material used for construction, but alternatively can form a frame to be covered in another material, such as a fabric. If covered in fabric, any suitable material, such as silk, cotton or wool can be used. Different knits or weaves of such fabric can be used, such as a terry-cloth, for example. Padding, such as a foam, foam rubber, cork or cotton and/or polyester batting can be used underneath a fabric covering. This can provide for a desirable appearance and feel of the garment holder, and can also allow for attachment of garments to the garment holder through use of pins, such as safety pins or straight pins.

Additionally, one or more areas can be provided on the garment organizer or on each garment holder individually, to allow display of indicia, as shown in FIGS. 2, 7 and 11. Such indicia can include a logo of a manufacturer or vendor, a trademark or the like. Additionally or alternatively, indicia can include labels, which can be customized by the user. Such labels can take on a variety of embodiments, but can include, for example, a paper label held in a clear pocket provided on the garment organizer and/or on individual garment holders. Alternatively, words or one's name can be embroidered in or printed on the fabric covering each garment holder. In no fabric covering is provided, indicia may simply be printed on whatever material from which the garment organizer and/or garment holders are made.

The invention further provides a method of organizing garments. The method includes the steps of providing garment organizer in accordance with the invention, placing a garment on at least one garment holder, and storing the garment organizer and garments.

The methods and devices of the present invention, as described above and shown in the drawings, provide for a garment organizer that facilitates organization and perusal through undergarments. It will be apparent to those skilled in the art that various modifications and variations can be made in the devices and methods of the present invention without departing from the spirit or scope of the invention. Thus, it is intended that the present invention include such modifications and variations.

What is claimed is:

1. A garment organizer comprising:

a) a plurality of garment holders, each garment holder configured and adapted to hold an article of womens underwear; and b) at least one connector for directly connecting the plurality of garment holders to each other and facilitating viewing of individual garments, wherein the at least one connector is defined by a protrusion extending outwardly from a first side of each garment holder, the protrusion defining a recess in a second opposing side of each garment holder, such that a protrusion of one garment holder engages and is received within a recess on an adjacent garment holder, wherein the connectors define an axis of rotation through their centers, and further wherein the at least one connector is adapted and configured to act as a pivot proximate one edge of the garment holders such that the plurality of garment holders can spread apart in a fan-like fashion about the axis of rotation by pivoting the garment holders with respect to each other about the axis of rotation to permit each pair of underwear to be viewed by a user simultaneously, wherein the plurality of garment holders are substantially T-shaped, and the at least one connector on each garment holder is integrally formed in each garment holder at an extremity of each garment holder.

2. The garment organizer of claim 1 , wherein each of the garment holders includes a contour to mimic a portion of a silhouette of a wearer.

3. The garment organizer of claim 2, further comprising an outer cover to conceal an undergarment mounted on the garment organizer.

4. The garment organizer of claim 3, wherein the outer cover is a box.

5. The garment organizer of claim 2, wherein at least one of the plurality of garment holders is covered in a fabric material.

6. The garment organizer of claim 2, wherein each garment holder includes an angled, recessed surface that is adapted and configured to facilitate engagement with an elastic waistband of an undergarment.

7. The garment organizer of claim 6, wherein each garment holder further includes at least one resilient clip integrally formed with the garment holder to engage a garment held by the garment holder.

8. The garment organizer of claim 6, wherein each garment holder further includes at least one hook to engage a garment held thereby.

9. The garment organizer of claim 6, wherein each garment holder further includes high friction material to engage the garment held thereby.

* * * * *